US010024618B1

(12) United States Patent
Moore et al.

(10) Patent No.: US 10,024,618 B1
(45) Date of Patent: Jul. 17, 2018

(54) MUZZLE BRAKE FOR A COMBAT RIFLE

(71) Applicant: FN AMERICA, LLC, McLean, VA (US)

(72) Inventors: Charles A. Moore, Columbia, SC (US); Thomas A. Mooty, Manchester, NH (US)

(73) Assignee: FN Herstal, SA, Herstal (BE)

( * ) Notice: Subject to any disclaimer, the term of this patent is extended or adjusted under 35 U.S.C. 154(b) by 0 days.

(21) Appl. No.: 15/404,310

(22) Filed: Jan. 12, 2017

Related U.S. Application Data

(60) Provisional application No. 62/278,738, filed on Jan. 14, 2016.

(51) Int. Cl.
*F41A 21/36* (2006.01)
*F41A 21/34* (2006.01)
*F41A 21/32* (2006.01)

(52) U.S. Cl.
CPC ..... *F41A 21/36* (2013.01); *F41A 21/325* (2013.01); *F41A 21/34* (2013.01)

(58) Field of Classification Search
CPC ..... F41A 21/26; F41A 21/30; F41A 21/32; F41A 21/325; F41A 21/34; F41A 21/36; F41A 21/38
USPC ..... 89/14.2, 14.3, 14.4; 42/1.06; 181/223
See application file for complete search history.

(56) References Cited

U.S. PATENT DOCUMENTS 786,230 A 3/1905 McClean
4,583,445 A 4/1986 Blair
4,643,073 A 2/1987 Johnson
4,879,942 A 11/1989 Cave
5,020,416 A 6/1991 Tripp
5,092,223 A 3/1992 Hudson
5,305,677 A 4/1994 Kleinguenther et al.
5,476,028 A 12/1995 Seberger
5,698,810 A 12/1997 Rose
5,798,474 A 8/1998 Rogers et al.
5,814,757 A 9/1998 Buss
7,059,235 B2 6/2006 Hanslick et al.
7,530,299 B1 * 5/2009 Poff ..... F41A 21/36 42/1.06
7,861,636 B1 1/2011 Hoffman
7,954,414 B2 6/2011 Dueck et al.
8,042,448 B1 10/2011 Sylvester et al.
8,047,115 B2 11/2011 Noveske
8,087,337 B1 1/2012 Cary
8,087,338 B1 * 1/2012 Hines ..... F41A 21/36 181/223
8,100,224 B1 1/2012 Olson
(Continued)

FOREIGN PATENT DOCUMENTS

GB 2152644 A 8/1985

*Primary Examiner* — Bret Hayes
(74) *Attorney, Agent, or Firm* — Nexsen Pruet, LLC; Todd A. Serbin; Michael A. Mann

(57) ABSTRACT

A muzzle brake includes a muzzle brake mount, a muzzle brake cone and a muzzle brake end cap welded to form a first nozzle, a larger first expansion chamber, a second nozzle and a smaller second expansion chamber. The first and second expansion chambers have pairs of lateral windows for venting combustion gases without net lateral forces on the rifle to which the muzzle brake is attached. The muzzle brake end cap has a toroidal interior surface to recirculate combustion gases within the second expansion chamber. An alignment pin attaches to the top center of the outside of muzzle brake mount as an aid to the user to align the lateral windows in a horizontal orientation.

20 Claims, 4 Drawing Sheets

(56) References Cited

U.S. PATENT DOCUMENTS

| | | | | |
|---|---|---|---|---|
| 8,205,538 | B2 | 6/2012 | Dueck et al. | |
| 8,424,440 | B1 * | 4/2013 | Carson | F41A 21/36 89/14.3 |
| 8,490,535 | B1 | 7/2013 | Moore et al. | |
| 8,511,425 | B2 | 8/2013 | Larue | |
| 8,578,832 | B2 | 11/2013 | Adolphsen | |
| 8,833,512 | B2 | 9/2014 | Smith et al. | |
| 8,910,746 | B1 | 12/2014 | McKenzie | |
| 9,080,829 | B1 | 7/2015 | Cellini | |
| 9,310,152 | B1 | 4/2016 | Poling | |
| D759,188 | S * | 6/2016 | Geissele | D22/108 |
| 2003/0106416 | A1 | 6/2003 | Vais | |
| 2003/0106417 | A1 * | 6/2003 | Vais | F41A 21/36 89/14.3 |
| 2004/0244571 | A1 * | 12/2004 | Bender | F41A 21/38 89/14.3 |
| 2005/0115394 | A1 * | 6/2005 | Matthews | F41A 21/30 89/14.4 |
| 2005/0252365 | A1 * | 11/2005 | Balbo | F41A 21/325 89/14.3 |
| 2008/0083321 | A1 | 4/2008 | Dueck et al. | |
| 2011/0107900 | A1 * | 5/2011 | Presz, Jr. | F41A 21/34 89/14.4 |
| 2013/0199071 | A1 * | 8/2013 | Lee | F41A 21/325 42/76.01 |
| 2013/0233162 | A1 | 9/2013 | Schneider | |
| 2014/0318887 | A1 * | 10/2014 | Latka | F41A 21/30 181/223 |
| 2016/0076844 | A1 * | 3/2016 | Miller, III | F41A 21/30 89/14.3 |

* cited by examiner

MUZZLE BRAKE FOR A COMBAT RIFLE

TECHNOLOGICAL FIELD

This disclosure is related to the field of muzzle brakes for combat rifles.

BACKGROUND

A muzzle brake is a device that is attached to the muzzle of a firearm in order to limit the flash at the muzzle that accompanies the discharge of a round of ammunition. In many cases, the flash is of no consequence. In combat and especially at night, the flash may give away the location of the marksman.

The flash results from the ignition of the combustion gases that follow the bullet down the barrel and which may ignite on exposure to the air as they leave the muzzle. The muzzle brake may limit this secondary ignition in various ways. For example, the combustion gases can be dispersed radially to reduce their concentration and cool them to a temperature low enough so that ignition is not likely to occur. The forces of the dispersing gas may cause the muzzle end of the firearm to move in an opposing direction, making it more difficult to fire accurately when firing multiple rounds.

Muzzle brakes generally accomplish their goal by redirecting portions of the dispersing gas in various directions including rearward. While rearward redirection is effective in reducing flash, it typically has the deleterious effect of exposing the operator of the firearm to a concussive force created by the high energy of the expanding gases.

An effective muzzle brake, one that prevents ignition and does so with as little effect on the firearm and the operator, would be advantageous in a combat or sporting rifle.

SUMMARY

According to its major aspects and briefly recited, the present disclosure describes a muzzle brake with a first nozzle in communication with a first expansion chamber, followed by a second nozzle and a second expansion chamber. The first and second expansion chambers have relatively large, opposing lateral windows for venting combustion gases. An alignment pin is attached to the muzzle break midway between the opposing lateral windows to assist the user in orienting the opposing lateral windows to direct combustion gases to the opposing lateral sides of the vertically oriented firearm so that the forces of the exiting gases offset each other so that vertical and net lateral movement of the muzzle is reduced.

A feature of the disclosure is a muzzle brake including a muzzle brake mount threaded on the inside to receive the threaded muzzle of a firearm. The muzzle brake mount has a collar and a threaded section that connects the muzzle of the firearm to a first nozzle formed in the muzzle brake mount. The first nozzle flares conically into a first chamber, which has first opposing lateral windows leading directly to the exterior of the muzzle brake mount. Next is a muzzle brake cone that forms the distal end of the first chamber. The muzzle brake cone has an exterior wall and an interior wall with a second entrance passing through the exterior wall to the interior wall and leading to a second nozzle.

The muzzle brake next includes a muzzle brake end cap that leads from the muzzle brake cone into a second expansion chamber, which has second opposing lateral windows. The muzzle brake end cap has an exit hole formed to enable a bullet fired from the firearm to pass through the muzzle brake mount, muzzle brake cone and muzzle brake end cap, passing through first and second nozzles and first and second expansion chambers and out the exit hole of muzzle brake end cap traversing the axis of muzzle brake.

Another feature of the present disclosure is that the first expansion chamber is larger than the second expansion chamber and its windows are longer than the windows in the second expansion chamber. The first opposing lateral windows and second opposing lateral windows of first expansion chamber and second expansion chamber are rectangular.

A feature of the present disclosure is that the end cap has a distal wall with a concave toroidal surface around the exit hole.

Another feature of the muzzle brake is that the muzzle brake end cap and the muzzle brake mount are welded to the muzzle brake cone to form the muzzle brake.

Another feature of the muzzle brake is the alignment pin attached to the muzzle brake mount equidistant from the first and second lateral windows so that the windows can be properly oriented to open laterally to the sides when the alignment pin is vertical.

Another feature of the muzzle brake is that the exit hole in the muzzle brake end cap is smaller than the entrance to the second nozzle and larger than the entrance to the first nozzle.

Those skilled in the art of muzzle brakes will appreciate other features and their advantages from a careful reading of the Detailed Description accompanied by the following drawings.

BRIEF DESCRIPTION OF THE DRAWINGS

In the figures.

DETAILED DESCRIPTION

Figure 1:
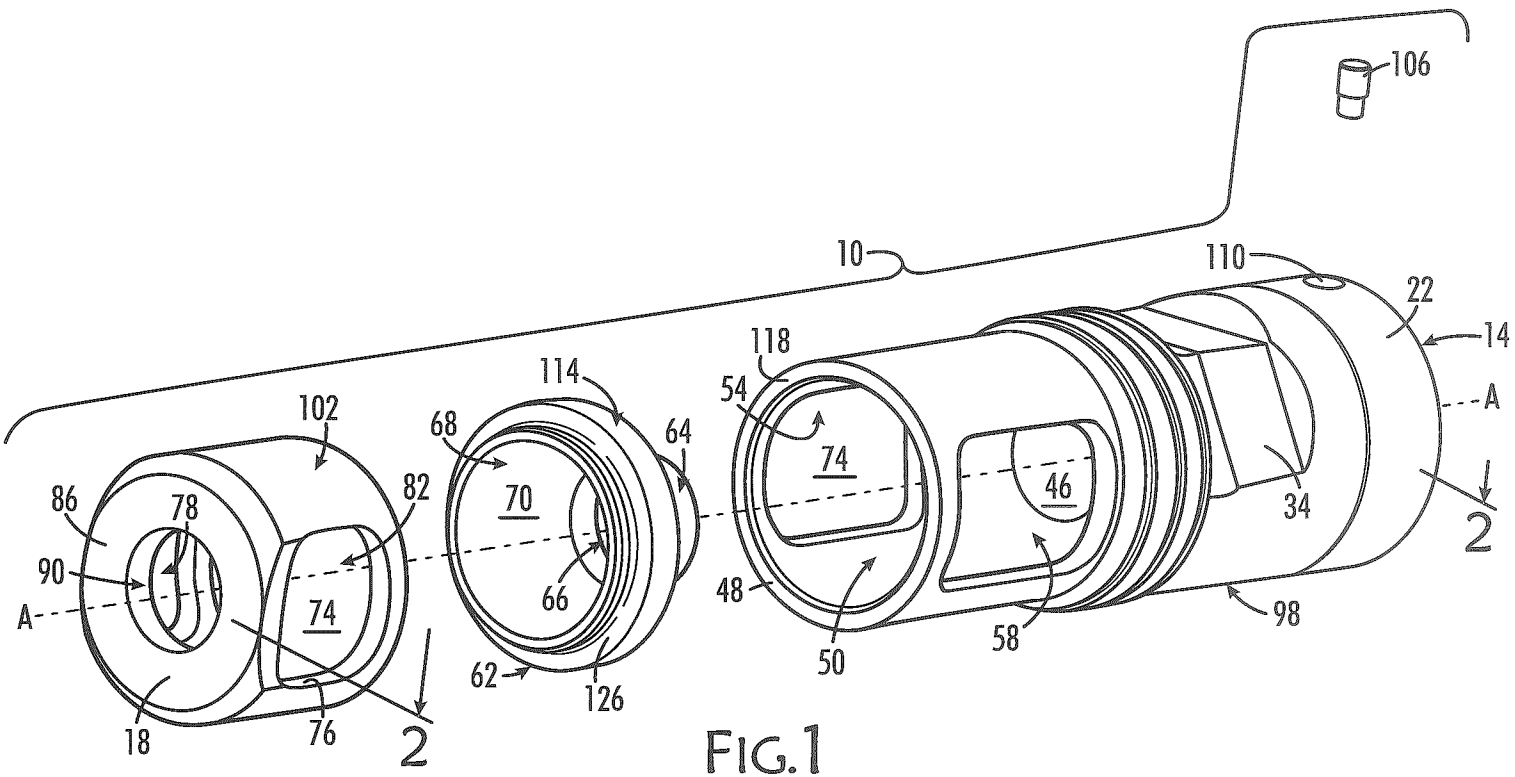
FIG. 1 is an exploded, upper-left-end, perspective view of a muzzle brake, according to an aspect of the present disclosure.
Figure 2:
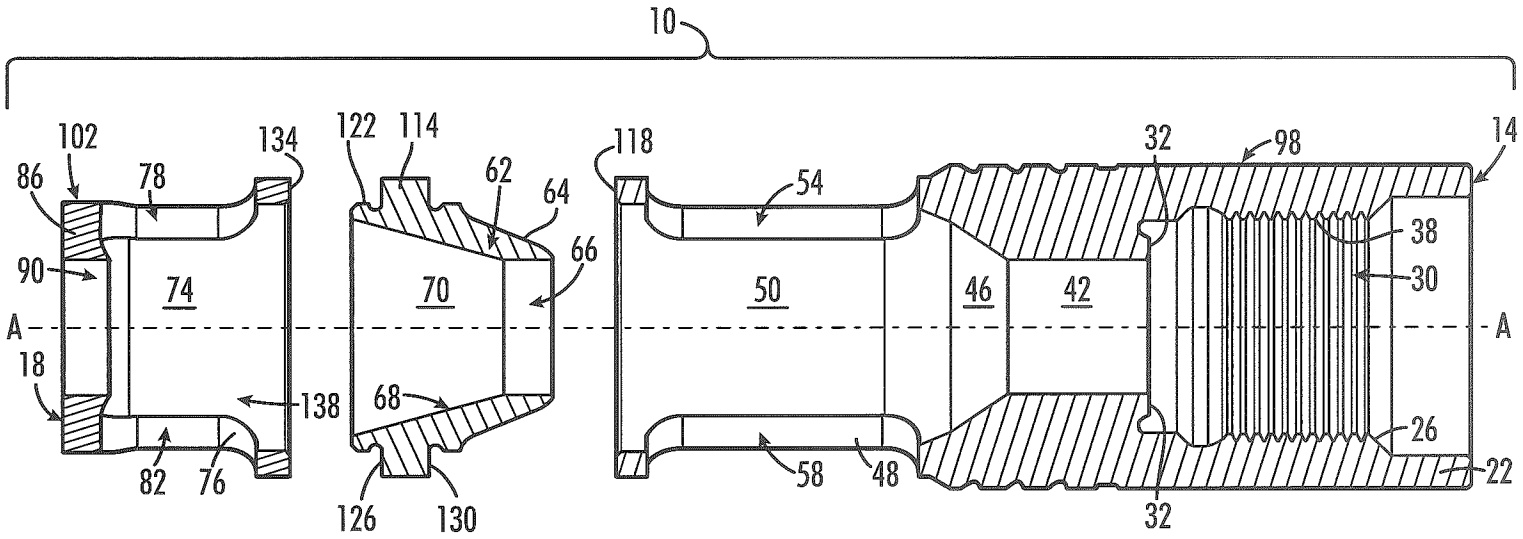
FIG. 2 is an exploded, top, cross-sectional view of the muzzle brake of FIG. 1 taken along lines 2-2, according the present disclosure.
Figure 3A:
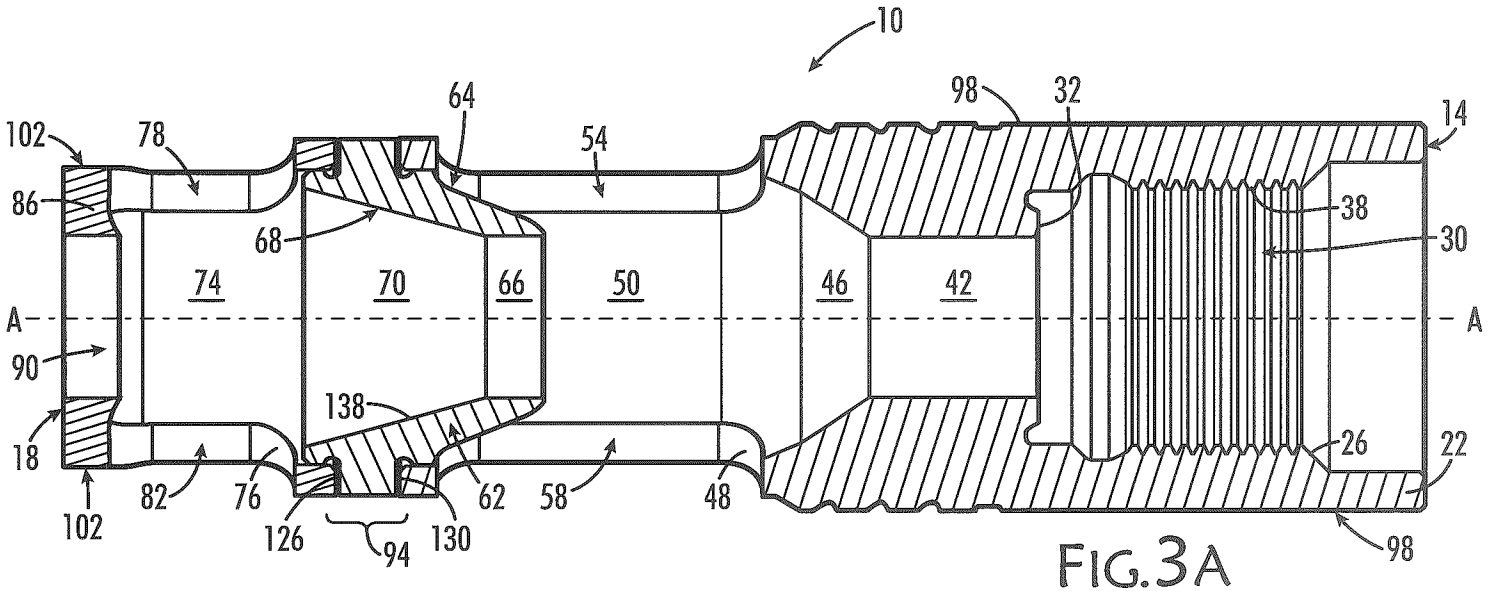
FIG. 3A is an assembled cross-sectional view of the muzzle brake, according to an aspect of the disclosure.
Figure 3B:
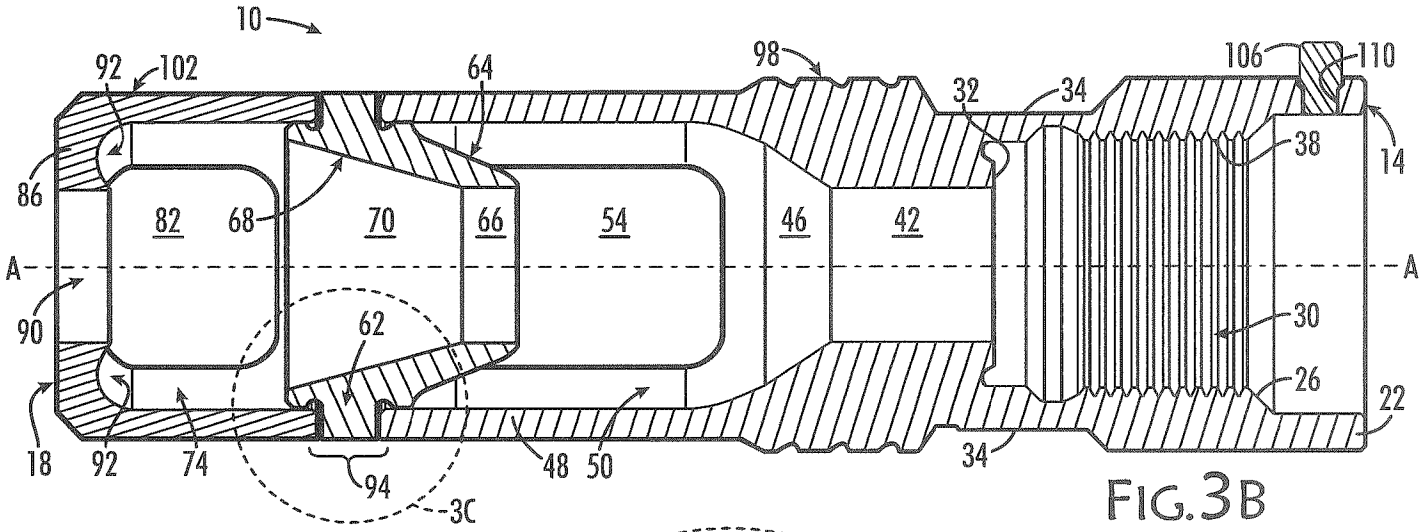
FIG. 3B is a side, cross-sectional view of the present muzzle brake, according to an aspect of the present disclosure.
Figure 3C:
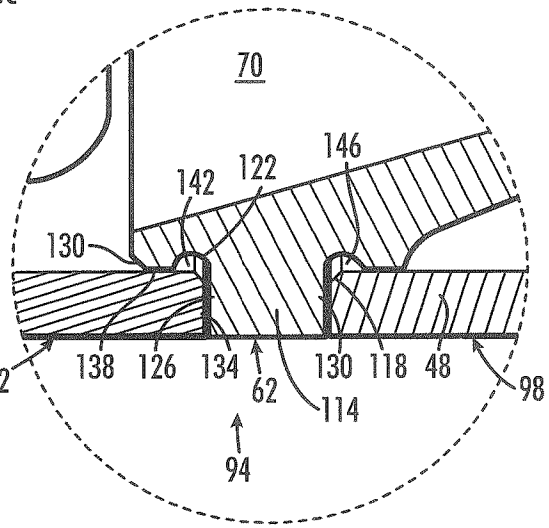
FIG. 3C is a detailed, cross-sectional view of the muzzle brake of FIG. 3B, according to an aspect of the disclosure.

Referring now to the figures, there is illustrated a muzzle brake 10 according to the present disclosure. Muzzle brake 10 is shown in a left side, perspective, exploded view in FIG. 1 and in an exploded, top cross-sectional view in FIG. 2. FIGS. 3A and 3B show top and side cross-sectional views, respectively, and FIG. 3C shows a detail of FIG. 3B.

Muzzle brake 10 has a first end 14, which receives the muzzle of a firearm (not shown). First end 14 is on the right end of muzzle brake 10 in FIGS. 1, 2, and 3A-3C while opposing second end 18 of muzzle brake 10 is on the left in these figures. The terms proximal and distal will be used herein to indicate closer to the first end 14 and closer to the second end 18 of muzzle brake 10 as shown in these figures. First end 14 of muzzle brake 10 includes a muzzle brake mount 98 and is the end which is attachable to the muzzle of a firearm.

First end 14 includes a collar 22 that is dimensioned to surround and receive the muzzle end of the barrel of a firearm. Inside collar 22 is a first step 26 followed by a threaded section 30 just distal of first step 26. Threaded section 30 has interior threads 38, as seen in FIG. 2, that correspond to the exterior threads at the end of barrel of a firearm. The end of the barrel can thus be inserted through collar 22 and threadably received into threaded section 30 until the barrel reaches a second step 32 and the portion of the barrel past its threads reaches first step 26. When the barrel reaches first step 26 and second step 32, it is fully seated inside muzzle brake mount 98.

Exterior to muzzle brake 10 are opposing flat sides 34. Flat sides 34 may receive the jaws of a tool such as a wrench or spanner for use in tightening muzzle brake mount 98 to the firearm barrel. Flat sides 34 are formed in opposing pairs on muzzle brake mount 98 with at least one such pair and potentially two or three such opposing pairs.

The shape of the interior of threaded section 30 receives and engages the end of the rifle muzzle securely against a first entrance 42 to a first nozzle 46. Entrance 42 has a diameter that is sized for a bullet to pass through, such as, for example 6.7 mm bullet, and then the bullet passes through first nozzle 46, which is conically formed with a linearly increasing radius in the distal direction and having an angle such as, for example, 70 degrees. Distal to first nozzle 46, is a first expansion chamber 50 defined by a wall 48 that may be cylindrical and have opposing, first lateral windows 54, 58. The radius of first expansion chamber 50 may be 17.2 mm.

First lateral windows 54, 58, are longer than they are wide, as measured in the direction of an axis A of muzzle brake 10, such as, for example, 20.75 mm long, versus 12.0 mm, as measured azimuthally. Combustion gases following a bullet will in part exit through first lateral windows 54, 58, and thus windows 54, 58, direct the forces of venting gases laterally to opposing sides so those forces offset each other resulting in negligible net lateral forces. Because, combustion gases cannot vent vertically from muzzle brake mount 98, they are less able to interfere with the marksman.

At the end of first expansion chamber 50 is a muzzle brake cone 62. Muzzle brake cone 62 has an exterior surface 64 and an interior surface 68. The exterior surface 64 of muzzle brake cone 62 helps to divide off a portion of gases received from first nozzle 46 for lateral dispersal from first expansion chamber 50 through windows 54, 58, from those gases traveling along axis A, which pass through a second entrance 66 following a bullet. Second entrance 66 has a diameter that is larger than the diameter of entrance 42 of first nozzle 46, and may be 9 mm in diameter, for example.

Entrance 66 leads immediately to a second nozzle 70 that promotes additional expansion of combustion gases that have followed the bullet. Second nozzle 70 is defined by the interior surface 68 of muzzle brake cone 62 which surface 68 flares uniformly and conically outward toward second end 18 at an angle less than that of the flare of first nozzle 46, such as, for example 55 degrees, and leads to a second expansion chamber 74 defined by a second wall 76 in a muzzle brake cap 102. Combustion gases trailing the bullet as it passes into second expansion chamber 74 along axis A may disperse as they pass through second nozzle 70.

Second expansion chamber 74 also has opposing second lateral windows 78, 82, for venting combustion gases. Although second expansion chamber 74 may be shorter than first expansion chamber 50, second lateral windows 78, 82, like first lateral windows 54, 58, are also rectangular and are longer axially than wider in the azimuthal direction. They are also nearly square, such as, for example, 12.2 mm long and 12.0 mm wide.

At the distal end of second expansion chamber 74, there is an end wall 86 lateral to exit hole 90 that has a concave toroidal shape, that is, it forms a concave ring 92 around a centrally-located exit hole 90 through which the bullet traveling along axis A exits. Concave ring 92 is defined by the shape of wall 86 as best seen in FIG. 3B. Exit hole 90 is larger in diameter than first entrance 42, for example 7.65 mm if first entrance 42 is 7.62 mm, smaller than second entrance 66 which may then be 9 mm. The surface of wall 86 is formed to have concave ring 92 in order to cause undispersed combustion gases to recirculate within second expansion chamber 74 and disperse through second lateral windows 78, 82.

Muzzle brake 10 may be formed by welding three parts together at a junction 94. The three parts are muzzle brake mount 98, muzzle brake cone 62, and muzzle brake end cap 102. Muzzle brake mount 98 may be welded to muzzle brake cone 62 and muzzle brake end cap 102 welded to with muzzle brake cone 62 or all three could be welded together. Muzzle brake cone 62 has an annular ridge 114 approximately midway along its exterior surface. The distal end of muzzle brake mount 98 has a beveled surface 118 that engages annular ridge 114 so as to seat muzzle brake mount 98 against muzzle brake cone 62.

As best seen in FIG. 3C, muzzle brake cone 62 has a compound distal surface 122 with a perpendicular distal face 126 and a beveled proximal face 130. Perpendicular distal face 126 is perpendicular to axis A of muzzle brake 10. The proximal end of muzzle brake end cap 102 has a corresponding perpendicular surface 134 formed to engage perpendicular distal face 126 of annular ridge 114 of muzzle brake cone 62.

Proximal end of muzzle brake end cap 102 also has an interior entrance surface 138 formed to receive second nozzle 70 into second expansion chamber 74 leaving a gap 142 at annular ridge 114. A gap 146 is also formed between muzzle brake mount 98 and muzzle brake cone 62 on the proximal side of annular ridge 114. Weldments securing muzzle brake mount 98 to muzzle brake end cap 102, with annular ridge 114 of muzzle brake cone 62 held securely between them, are made in gaps 142 and 146.

An alignment pin 106 is also welded into a slot 110 in muzzle brake mount 98 midway between first lateral windows 54, 58, and second lateral windows 78, and 82 to assist in alignment of muzzle brake 10 with the firearm so that windows 54, 58, 78, and 82 open laterally with respect to a vertically oriented, standing shooter who is holding the firearm with alignment pin 106 at the top of muzzle brake 10 so that the forces from the exiting combustion gases are directed equally to the sides and tend to cancel. Orienting alignment pin 106 vertically then results in combustion gases being expelled laterally in a way that those gases directed through window 54 are offset by those directed through window 58, and those gases that flow through second lateral window 78 are offset by those directed through second lateral window 82, and the net lateral forces of the escaping combustion gases essentially cancel out.

Those familiar with firearms with muzzle brakes will appreciate from the foregoing description of features of the disclosure that many substitutions and modification can be made without departing from the spirit and scope of the disclosure.

What is claimed is:

1. A muzzle brake, comprising:

(a) a muzzle brake mount having a proximal end, a distal end, and an exterior surface, said muzzle brake mount having (i) a collar on said proximal end of said muzzle brake mount dimensioned to receive a muzzle of a firearm, (ii) a threaded section distal to and in communication with said collar and operable to receive said muzzle of said firearm, (iii) a first nozzle distal to and in communication with said threaded section, said first nozzle having a first entrance, and (iv) a wall defining a first expansion chamber in communication with said first nozzle and having first opposing lateral windows leading to said exterior surface of said muzzle brake mount;

(b) a muzzle brake cone, configured with a conical shape expanding towards a distal end of the muzzle brake, in communication with and distal to said first expansion chamber of said muzzle brake mount, said muzzle brake cone having an exterior surface, an interior surface, and a second entrance running from said exterior surface to said interior surface of said muzzle brake cone, and wherein said interior surface of said muzzle brake cone defines a second nozzle; and (c) a muzzle brake end cap distal to said second nozzle, said muzzle brake end cap having a second wall defining a second expansion chamber and having second opposing lateral windows therethrough and an exit hole formed therein, the entrance to said second nozzle of said muzzle brake cone and the entrance to said first nozzle of said muzzle brake mount being aligned along an axis to enable a bullet fired from said firearm to pass through said muzzle brake along said axis through said muzzle brake mount, said muzzle brake cone and out of said exit hole of said muzzle brake end cap, and wherein combustion gases disperse through said first opposing lateral windows of said first expansion chamber and said second opposing lateral windows of said second expansion chamber.

2. The muzzle brake as recited in claim 1, wherein said first expansion chamber is larger than said second expansion chamber.

3. The muzzle brake as recited in claim 1, wherein said first opposing lateral windows in said first expansion chamber are longer than said windows in said second expansion chamber.

4. The muzzle brake as recited in claim 1, wherein said first opposing lateral windows in said first expansion chamber are rectangular.

5. The muzzle brake as recited in claim 1, wherein said second opposing lateral windows in said second expansion chamber are rectangular.

6. The muzzle brake as recited in claim 1, wherein said first nozzle flares linearly.

7. The muzzle brake as recited in claim 1, wherein said second nozzle flares linearly.

8. The muzzle brake as recited in claim 1, wherein said muzzle brake end cap has a distal wall having a concave toroidal surface around said exit hole.

9. The muzzle brake as recited in claim 1, wherein said muzzle brake end cap and said muzzle brake mount are welded to the muzzle brake cone to form said muzzle brake.

10. The muzzle brake as recited in claim 1, wherein said exit hole in said muzzle brake end cap is smaller than said entrance of said second nozzle.

11. The muzzle brake as recited in claim 1, wherein said exit hole in said muzzle brake end cap is larger than said entrance to said first nozzle.

12. The muzzle brake as recited in claim 1, further comprising an alignment pin attached to said muzzle brake mount.

13. The muzzle brake as recited in claim 12, wherein said alignment pin is attached to said muzzle brake mount equidistant between said first opposing lateral windows.

14. A muzzle brake, comprising:

(a) a muzzle brake mount having a proximal end, a distal end, and an exterior surface, said muzzle brake mount having (i) a collar on said proximal end of said muzzle brake mount dimensioned to receive a muzzle of a firearm, (ii) a threaded section distal to and in communication with said collar and operable to receive a threaded end of said muzzle of said firearm, (iii) a first nozzle distal to and in communication with said threaded section, said first nozzle having a first entrance, and (iv) a wall defining a first expansion chamber in communication with said first nozzle, said wall having first opposing lateral windows leading to said exterior surface of said muzzle brake mount;

(b) a muzzle brake cone, configured with a conical shape expanding towards a distal end of the muzzle brake, in communication with and distal to said first expansion chamber of said muzzle brake mount, said muzzle brake cone having an exterior surface, an interior surface, and a second entrance running from said exterior surface to said interior surface of said muzzle brake cone, and wherein said interior surface of said muzzle brake cone defines a second nozzle; and (c) a muzzle brake end cap distal said second nozzle, said muzzle brake end cap having (i) a second expansion chamber with a second wall defining an interior and having second opposing lateral windows therethrough and an exit hole formed therein, said second entrance to said second nozzle of said muzzle brake cone and said first entrance to said first nozzle of said muzzle brake mount being aligned along an axis to enable a bullet fired from said firearm to pass through said muzzle brake along said axis through said muzzle brake mount, said muzzle brake cone and out of said exit hole of said muzzle brake end cap, and wherein combustion gases disperse through said first opposing lateral windows of said first expansion chamber and said second opposing lateral windows of said second expansion chamber.

15. The muzzle brake of claim 14, wherein said muzzle brake mount and said muzzle brake end cap are welded to said muzzle brake cone.

16. The muzzle brake of claim 14, wherein said first opposing lateral windows are diametrically opposing, and wherein said muzzle brake further comprises an alignment pin attached to said muzzle brake mount between said two windows.

17. The muzzle brake of claim 14, wherein said exit hole in said muzzle brake end cap is smaller than said entrance of said second nozzle and larger than said entrance to said first nozzle.

18. The muzzle brake of claim 14, wherein said first lateral windows and said second lateral windows are rectangular.

19. The muzzle brake of claim 14, wherein said first nozzle is flared by a larger angle than said second nozzle is flared.

20. The muzzle brake of claim 14, wherein said muzzle brake mount has a first step between said collar and said threaded section and a second step between said threaded section and said first nozzle.

* * * * *